US005107996A

United States Patent [19]

Whittaker

[11] Patent Number: 5,107,996

[45] Date of Patent: Apr. 28, 1992

[54] APPARATUS FOR THE SUSPENSION STORAGE OF ARTICLE OF CLOTHING

[76] Inventor: Greg Whittaker, 191 Sherbourne St., Apt. 402, Toronto, Ontario, M5A 3X1, Canada

[21] Appl. No.: 714,528

[22] Filed: Jun. 13, 1991

[30] Foreign Application Priority Data

Jun. 13, 1990 [CA] Canada ..... 2018912

[51] Int. Cl.[5] ..... A47F 5/00

[52] U.S. Cl. ..... 211/116; 211/113; 248/340

[58] Field of Search ..... 211/116, 113, 117, 118; 248/340

[56] References Cited

U.S. PATENT DOCUMENTS 2,699,263 1/1955 Ove ..... 211/116 X
3,133,643 5/1964 Lester ..... 211/116
3,212,647 10/1965 Meyer et al. ..... 211/118
3,794,182 2/1974 Royeton ..... 211/116 X
4,129,218 12/1978 Koellner ..... 211/116
4,308,962 1/1982 Fahmi ..... 248/340 X
4,953,717 9/1990 Rosch ..... 211/116 X

*Primary Examiner*—Robert W. Gibson, Jr.
*Attorney, Agent, or Firm*—Jeffrey T. Imai; Arne I. Fors

[57] ABSTRACT

A garment supporting apparatus for the efficient suspension of articles of clothing in a constricted space is described. The apparatus comprises a brace element with a pivotally engageable mounting hook on each end for attaching to a garment rod. The brace element includes a series of spaced apart holes for suspending a number of clothes hangers and a series of laterally projecting integral hooks, along at least one longitudinal edge, for suspending a further number of clothes hangers where one of the mounting hooks is released from the rod.

3 Claims, 3 Drawing Sheets

FIG.1
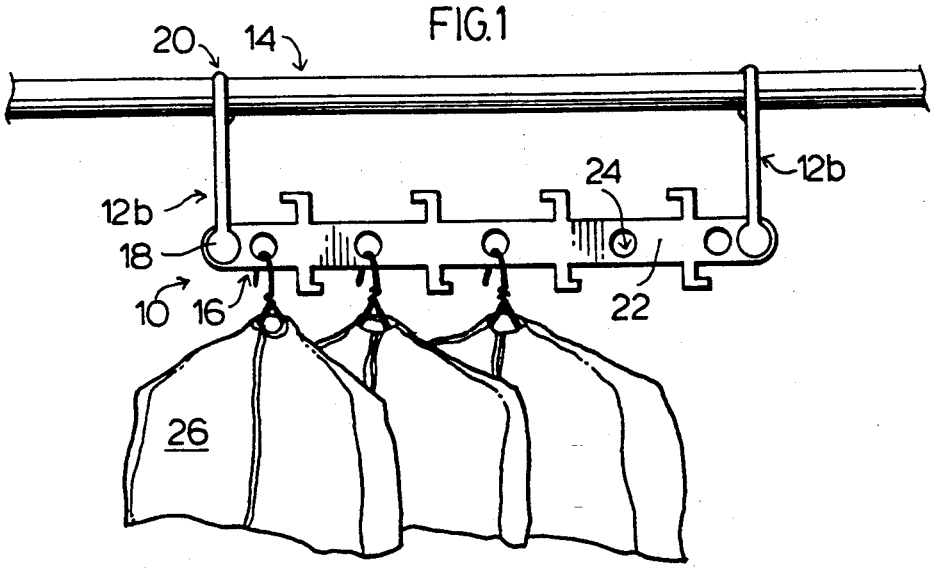
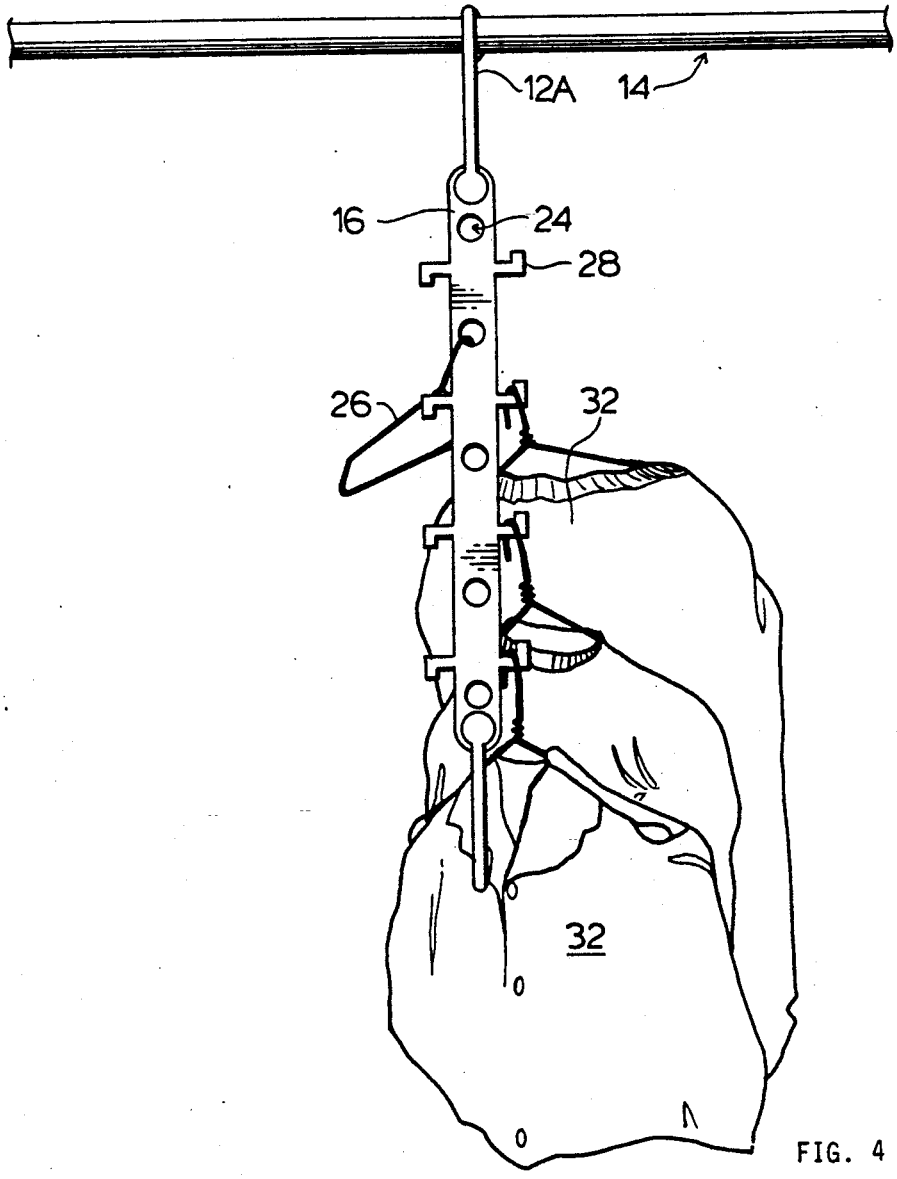
FIG. 4

APPARATUS FOR THE SUSPENSION STORAGE OF ARTICLE OF CLOTHING

This invention relates to an apparatus for the efficient storage of articles of clothing. More particularly, it relates to an apparatus for the efficient suspension of articles of clothing within a constricted space.

Certain articles of clothing, such as shirts and jackets should be stored in upright suspension to avoid creasing. Since modern urban houses and apartments have little storage capacity in the closet space available, various attempts have been made to devise a more efficient use of the space available. With this in mind, some modern closets have sliding panels and rotatable storage shelves. These provide space efficiency but are expensive to install.

The easiest and least expensive method for hanging garments remains the simple garment rod. Consequently, attempts have been made in the past to provide devices whereby several articles of clothing can be suspended downwardly one from the other, utilizing a single hanging zone on the garment rod itself.

One attempt at providing such a space saving device involves an extended bar or brace with pivotally attached hooks at each end for suspending the device from the garment rod. The bar includes a number of holes extending along its side from which clothes hangers can then be suspended. One of the mounting hooks of the device is then released so that the shaft can hang downwardly with the various clothes hangers suspended therefrom.

The applicant has devised an improvement over this device, which results in an additional 50% or more garment storage capacity being added within the closet area.

It is therefore an object of this invention to provide an apparatus exhibiting improved efficiency in the storage of garments.

It is an object of another aspect of the invention to provide a more efficient allocation of storage space while storing articles of clothing on conventional hangers.

It is an object of yet another aspect of the invention to provide for the suspension of clothes hangers on both sides of a descending shaft or brace suspended from a single mounting hook.

These and other objects are achieved by means of an apparatus comprising:

- a longitudinal brace element having a front face and a back face;
- a first mounting hook at one end of said brace and a second mounting hook at the other end of said brace, each mounting hook having a brace securing end and a rod engaging end, said brace securing end being pivotally engageable at one said end of said brace, and each said rod engaging end being adapted for engagement with a substantially horizontally mounted garment rod;
- a plurality of spaced apart holes along said longitudinal brace element, each adapted for supporting a clothes hanger thereon and a plurality of laterally projecting integral hooks spaced apart along one longitudinal edge of said brace element and having an inner hanger engaging curvature which is aligned in the direction of the first mounting hook, whereby disengagement of said second mounting hook from said rod will cause vertical suspension of said brake element and upright alignment of the inner hanger engaging curvature of each of said integral hooks to provide hanger support surfaces thereon.

In the drawings:

FIG. 1 is a plan view of one embodiment of the apparatus of the present invention mounted on a garment rod by both mounting hooks, with hung garments hangers suspended therefrom;

FIG. 4 is a plan view of the apparatus mounted on a garment rod by a single mounting hook, with hung garments suspended from both sides of the substantially vertical brace member.

Figure 2:
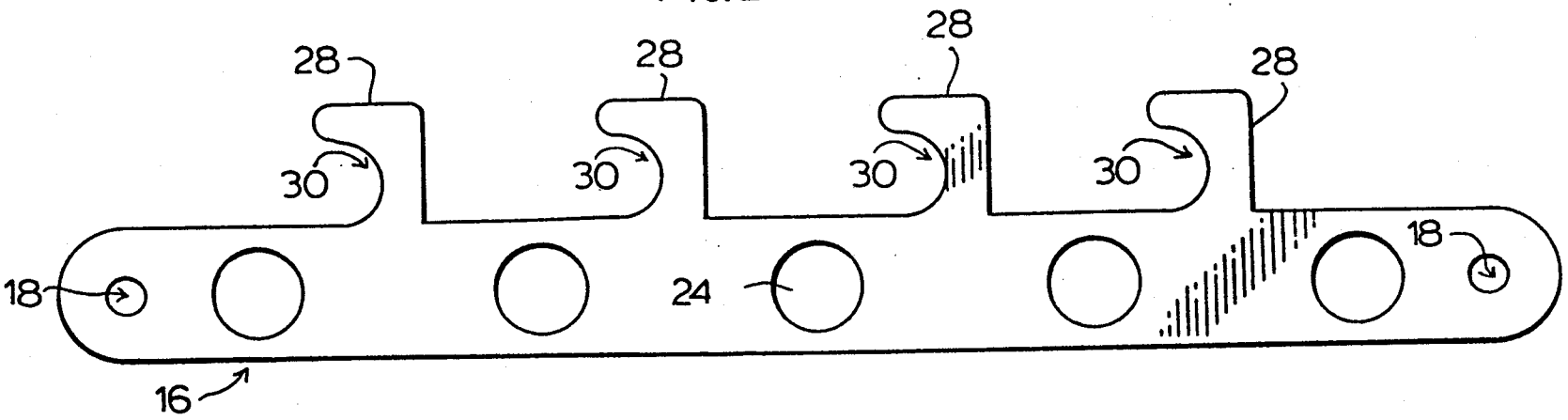
FIG. 2 is a plan view of the face of one embodiment of the brace member of the apparatus.

In FIG. 1, an apparatus of the present invention shown generally at 10 is connected by means of spaced apart mounting hooks 12*a* and 12*b* to a garment rod 14. When so mounted, the longitudinal brace element 16 is suspended in a substantially horizontal position and parallel to rod 14.

Mounting hooks 12*a* and 12*b* are pivotally secured at their respective brace securing end to brace element 16 through holes 18, so that each mounting hook is pivotable on either side of the longitudinal axis of the brace element 16, with the curved rail grasping end 20 aligned perpendicular to face 22 of the brace element. When so positioned, the hooks 12*a* and 12*b* may engage rod 14 with their rod engaging end 20. The face 22 of brace element 16 will then be presented with engaging holes 24 aligned forwardly for easy access.

It is preferable that mounting hooks 12*a* and 12*b* be secured in mounting holes 18 through the same front face so that the curved grasping ends are in the same direction. However, the apparatus could be installed on rail 14 if hooks 12 were in opposite direction, but might be more difficult to connect and remove.

With the apparatus so aligned, garment hangers 26 can be suspended along the brace element in spaced apart alignment by engaging the hanger hooks in one of the engaging holes 24. As illustrated in FIG. 1, such hangers would usually uphold shirts, jackets or other garments. The engaging holes 24 are so spaced apart that items on the respective hangers would be readily accessible and a hanger could be removed or replaced in any one of the engaging holes 24 without disturbing the other items.

In the embodiment of FIG. 1, the brace element 16 includes five spaced apart engaging holes 24. Fewer holes could be substituted in the brace element but fewer than three such holes would diminish the space saving advantages of the apparatus. A longer brace element could accommodate more than five holes. If the brace element is too long however, some of the garments might touch the floor when the brace element is suspended from only one of the mounting hooks. The reason for disconnecting one of the mounting hooks will be described in more detail below with particular reference to FIG. 4.

FIG. 2 shows a longitudinal brace element 16 with mounting hooks removed. The front face is shown substantially as presented forwardly when the apparatus is mounted on a garment rod 14 in the manner shown in FIG. 1. Of course, when so mounted, a mounting hook would be pivotally engaged in each of mounting holes 18.

Spaced apart hanger engaging holes 24 are large enough to receive and hold the hook of a garment hanger. A number of laterally projecting integral hooks 28 extend above the upper longitudinal edge of brace element 16. Each integral hook 28 has an inner hanger engaging curvature 30 for engaging and holding a further series of garment hangers in the manner to be described below. It should be noted that the inner hanger engaging curvature 30 of all of the integral hooks 28 are aligned in the same direction, namely toward the left hand side of the illustration.

The strength of brace element 16 can be reinforced by bending a narrow portion (not shown) along its lower longitudinal end into a substantially perpendicular ridge. Such a ridge would strengthen the brace element against axial distortion when supporting a heavier garment load than usual.

When the apparatus is mounted on garment rod 14, as shown in FIG. 1, and garment hangers 26 supporting various garments are suspended in engaging holes 24, further space can be saved in the garment storage area by disconnecting one of the mounting hooks, thereby permitting the brace element 16 to suspend downwardly from its remaining supported end.

When using the embodiment of the brace element shown in FIG. 2, mounting hook **12*b* is disconnected. This will allow the brace element 16 to hang so that inner hanger engaging curvature 30 of the laterally projecting integral hooks 28** will all be facing upward. These hooks then provide additional hanger space for a further set of garment hangers.

Figure 3:
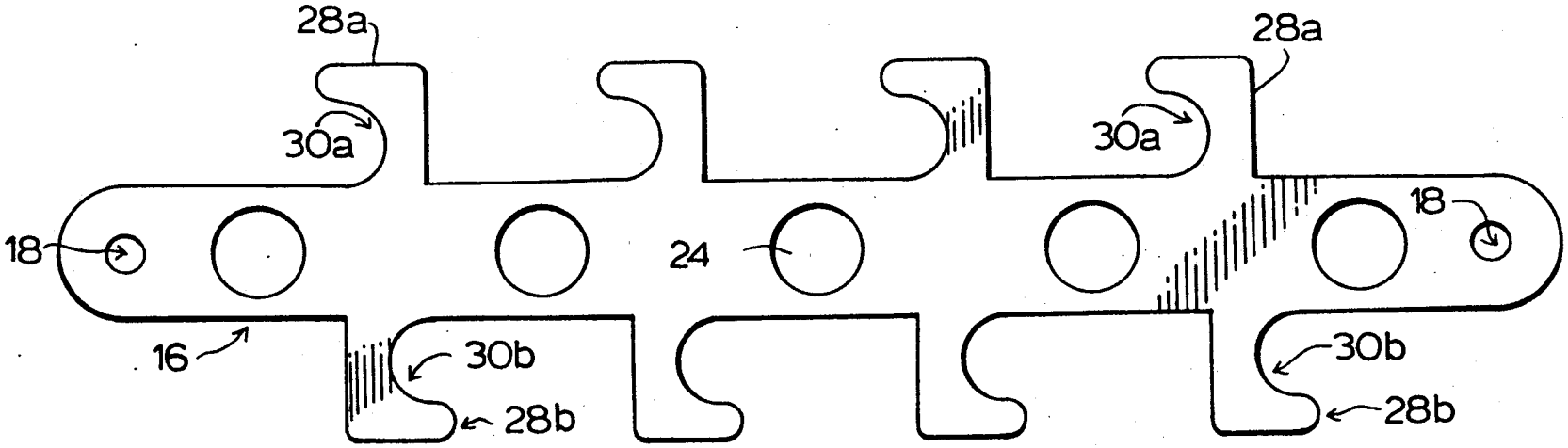
FIG. 3 is a plan view of the face of another embodiment of the brace member of the apparatus.

In the embodiment shown in FIGS. 1, 3 and 4, a series of four integral hooks 28 are provided on each side with a hook extending outwardly from the area between holes 24. This location between the holes is for ease and economy of manufacture. While fewer or more hooks could be used, their number is basically depending upon the length of bracket element 16.

FIG. 2 shows one preferred embodiment of brace element 16, FIG. 3 shows an alternative embodiment. In this embodiment, a further set of integral hooks are provided along the lower longitudinal edge of the brace element. In this drawing, the elements are identified by the same number references as in FIG. 2, but with the upper integral hooks indicated as **28*a* and the lower series identified as 28*b*. It can be noted that the inner hanger engaging curvature 30*b* of hooks 28*b* all face a direction opposite to curvature 30*a***, namely toward the right hand side of the figure.

With the embodiment of FIG. 3 used in the apparatus, mounting on a garment rod 14 is carried out as shown in FIG. 1. After garment hangers are engaged in engaging holes 24, either mounting hook **12*a* or 12*b* can be disconnected to suspend brace element 16 downwardly as shown in FIG. 4. When mounting hook 12*b* is disconnected, the brace element 16 is suspended by hook 12*a* and the inner hanger engaging curvature 30*a* of integral hooks 28*a*** are positioned upward for the reception of an additional series of garment hangers.

Alternatively, when mounting hook **12*a* is disconnected, the brace element 16 is suspended by hook 12*b* and the inner hanger engaging curvature 30*b* of integral hooks 28*b*** are presented upwardly for the reception of an additional series of garment hangers.

In the illustration of FIG. 4, hangers 26 and 32 are shown projected tangentially from brace element 16. When garments are suspended on each of these hangers, they will tend to be supported outwardly in a "Christmas-tree" arrangement. By providing a series of integral hooks 28 along one side of bracket element 16 instead of a second series of holes on a broader bracket element, the applicant's apparatus provides a means whereby one of hangers 26 or 32 can be removed or replaced while the apparatus is suspended, without disturbing the surrounding hangers or the garments suspended from them.

This embodiment has the versatility of being capable of being swung either way, which is advantageous in a restricted storage area. The use of two sets of integral hooks as shown would, of course, not easily permit a perpendicular strength supporting rim along either longitudinal side of the brace member. For some uses, the versatility provided by a double set of integral hooks outweigh the possible drawbacks.

It will be apparent that various modifications can be made to the present invention without departing from the essence of the invention as described above or as recited in the appended claims.

I claim:

1. A garment supporting apparatus suspendible from a garment rod comprising:

a longitudinal brace element having a front face and a back face;

a first mounting hook at one end of said brace and a second mounting hook at the other end of said brace, each mounting hook having a brace securing end and a rod engaging end, said brace securing end being pivotally engageable at one respective end of said brace element and each rod engaging end being adapted for engagement with a substantially horizontally mounted garment rod;

a plurality of spaced apart holes along said longitudinal brace element, each adapted for supporting a clothes hanger thereon;

a plurality of laterally projecting integral hooks spaced apart along one longitudinal edge of said one side of said brace element and having an inner hanger engaging curvature which is aligned in the direction of the first mounting hook whereby disengagement of said second mounting hook from said rod will cause vertical suspension of said brace element and alignment of the inner hanger engaging curvature of each of said integral hooks to provide hanger support surfaces thereon.

2. An apparatus as claimed in claim 1 wherein each said mounting hook is pivotably secured through the same said face of the brace element.

3. An apparatus as claimed in 1 wherein said brace element includes a further set of laterally projecting integral hooks spaced apart along a longitudinal edge of said brace element on the opposite side of said holes from said first set of said integral hooks, the inner engaging curvature of which are aligned in the direction of the second mounting hook whereby disengagement of said first mounting hook from said rod will cause vertical suspension of said brace element and upright alignment of the inner hanger support curvature of each of said further integral hooks to provide hanger support surfaces thereon.

* * * * *